US007147579B2

(12) United States Patent
Forrest

(10) Patent No.: US 7,147,579 B2
(45) Date of Patent: Dec. 12, 2006

(54) PASS RUSH TRAINER

(76) Inventor: Charles P. Forrest, P.O. Box 579, Stapleton, AL (US) 36578

( * ) Notice: Subject to any disclaimer, the term of this patent is extended or adjusted under 35 U.S.C. 154(b) by 0 days.

(21) Appl. No.: 10/144,988

(22) Filed: May 15, 2002

(65) Prior Publication Data

US 2003/0216194 A1 Nov. 20, 2003

(51) Int. Cl.
*A63B 69/00* (2006.01)

(52) U.S. Cl. ..... 473/441; 473/422; 473/445; 482/87; 21/788

(58) Field of Classification Search ..... 473/439–445, 473/454, 470, 476, 477, FOR. 125, 128; 273/348, 407, 108.22, 108.4, 108.41, 108, 273/317.5; 446/325; 482/82–86, 90, 128, 482/130, 140, 142, 121; D21/686, 688, 677; 248/624, 160; 40/602, 608
See application file for complete search history.

(56) References Cited

U.S. PATENT DOCUMENTS

| | | | | | |
|---|---|---|---|---|---|
| 419,285 | A * | 1/1890 | Sanborn | 482/90 |
| 928,674 | A * | 7/1909 | Lenz | 473/454 |
| 2,469,301 | A * | 5/1949 | Johnston | 473/277 |
| 2,934,343 | A * | 4/1960 | Schumacher | 473/445 |
| 3,662,482 | A * | 5/1972 | Sarkisian | 40/602 |
| 3,907,291 | A * | 9/1975 | Parker | 473/445 |
| 4,069,995 | A * | 1/1978 | Miller | 248/118.1 |
| 4,288,053 | A * | 9/1981 | Sarkisian | 248/218.4 |
| 4,351,527 | A * | 9/1982 | Crisp, Jr. | 482/122 |
| 4,575,040 | A * | 3/1986 | Seely | 248/624 |
| 5,046,724 | A * | 9/1991 | Sotomayer | 482/90 |
| 5,261,821 | A * | 11/1993 | Shic | 434/247 |
| 5,342,267 | A * | 8/1994 | Adams et al. | 482/83 |
| 5,485,993 | A * | 1/1996 | Lipsett | 473/448 |
| 5,507,044 | A * | 4/1996 | Williamson et al. | 5/81.1 RP |
| 5,554,088 | A * | 9/1996 | Zlojutro | 482/83 |
| 5,676,378 | A * | 10/1997 | West | 273/390 |
| 5,829,178 | A * | 11/1998 | Hillstrom | 40/610 |
| 5,860,897 | A * | 1/1999 | Gilbert et al. | 482/130 |
| 5,899,835 | A * | 5/1999 | Puranda | 482/90 |
| 5,921,895 | A * | 7/1999 | Lynch et al. | 482/83 |
| 6,022,303 | A * | 2/2000 | Abdo | 482/140 |
| 6,077,204 | A * | 6/2000 | Dickinson, Jr. | 482/83 |
| 6,217,483 | B1 * | 4/2001 | Kallassy | 482/38 |
| 6,237,883 | B1 * | 5/2001 | Levin et al. | 248/176.1 |
| 6,248,047 | B1 * | 6/2001 | Abdo | 482/130 |
| 6,458,062 | B1 * | 10/2002 | Conner | 482/129 |
| 6,547,191 | B1 * | 4/2003 | McDonald | 248/49 |
| 6,755,381 | B1 * | 6/2004 | Levin et al. | 248/163.1 |

FOREIGN PATENT DOCUMENTS

RU 2140312 C1 * 10/1999

* cited by examiner

*Primary Examiner*—Mitra Aryanpour
(74) *Attorney, Agent, or Firm*—H. Jay Spiegel

(57) ABSTRACT

A pass rush trainer has a rigid base that is height adjustable. Two coil torsion springs are mounted on the base and extend upwardly therefrom. At their upper extents, the springs are coupled to a frame including two outwardly extending arms which support the arms of a dummy or pad that is mounted on it. The distance between the arms is easily adjustable so that a pass rusher can practice against differing degrees of "wing span" of an offensive lineman. The pad itself includes a torso that is draped over the base and springs of the inventive device, has a portion simulating the shoulders and head of a pass blocker, and includes two padded arms mounted over the arms of the frame.

19 Claims, 9 Drawing Sheets

PASS RUSH TRAINER

BACKGROUND OF THE INVENTION

The present invention relates to a pass rush trainer. The invention consists of a frame mounted on a base that may or may not be secured on a ground surface. The frame includes a double spring feature that allows controllable movements of an upper portion of the frame during use. A dummy including two arms is mountable over the frame.

In the prior art, tackling dummies are well known. However, Applicant is unaware of any such device that has been specifically designed to allow a pass rusher to train in fending off the blocks of an offensive lineman. Applicant is unaware of any such device which includes a rigid base having mounted at its upper extent a flexible support for a pad, with the flexible portion spaced above the ground surface to mimic the movements of a pass blocker from the waist up.

Applicant is aware of the following prior art:

U.S. Pat. No. 1,663,659 to Hart et al. discloses a tackling dummy including a torso and legs, with the legs being attached into a recessed base, with each leg having three springs coupled between the base and a location equivalent to the location of the human hip. The present invention differs from the teachings of Hart et al. as contemplating a base that extends rigidly upwardly from the ground surface and wherein the starting point for a pair of springs is elevated a significant distance off the ground.

U.S. Pat. No. 1,884,816 to Oakes discloses a football blocking dummy that is pivotably mounted at ground level by a single spring mechanism. The present invention differs from the teachings of Oakes as contemplating support of a frame elevated off the ground by two springs, the lower terminations of which are spaced a significant distance off the ground.

U.S. Pat. No. 2,197,545 to Bachman et al. discloses a football dummy including a heavy base embedded below the ground surface and a dummy pivoted at ground level by a mechanism including a single elongated spring. The present invention differs from the teachings of Bachman et al. as contemplating a rigid base extending upwardly from the ground surface and a double torsion spring mounted at the upward extent of the rigid base.

U.S. Pat. No. 2,913,245 to Landis discloses an athletic tackling bag including an underground base and a dummy pivoted at ground level through a mechanism including a single spring. The present invention differs from the teachings of Landis for the same reasons set forth above concerning Oakes and Bachman et al.

U.S. Pat. No. 2,934,343 to Schumacher discloses a football blocking and tackling practice machine in which a sled is provided on which a dummy is pivotably mounted and biased by virtue of a spring. The present invention differs from the teachings of Schumacher as contemplating a rigid base upwardly extending and to which double torsion springs are mounted to support a frame supporting a dummy.

U.S. Pat. No. 5,335,906 to Delker discloses a dummy apparatus including two arms. The present invention differs from the teachings of Delker as contemplating arms that are adjustable in separation as well as a rigid base extending upwardly and to which is attached two torsion springs.

SUMMARY OF THE INVENTION

The present invention relates to a pass rush trainer. The present invention includes the following interrelated objects, aspects and features:

(1) In a first aspect, the inventive pass rush trainer contemplates a rigid base that may either be mounted on a post embedded in the ground or on a heavy support such as a tire filled with water. The base is height adjustable to accommodate the device to players of differing sizes.

(2) At the top end of the base, two coil torsion springs are mounted via a first plate and extend upwardly therefrom. At their upper extents, the springs are coupled to a frame or bracket via a second plate. The frame or bracket includes two outwardly extending arms which support the arms of a dummy or pad that is mounted thereover.

(3) The frame or bracket is designed such that the distance between the arms thereof is easily adjustable so that a pass rusher can practice against differing degrees of "wing span" of an offensive lineman.

(4) The pad itself includes a torso that is draped over the base and springs of the inventive device, has a portion simulating the shoulders and head of a pass blocker, and includes two padded arms mounted over the arms of the frame.

(5) When a pass rusher strikes the arms of the pad or dummy, the torsion springs allow pivoting, flexing and rotating movements and cause the frame to tend to spring back to a neutral position simulating the efforts of a pass blocker to maintain a blocking position that is aligned with the position of the blocker's feet.

Accordingly, it is a first object of the present invention to provide a pass rush trainer.

It is a further object of the present invention to provide such a device in which a rigid base is mounted either on a support fixed to the ground or by a heavy base that is difficult to move.

It is a still further object of the present invention to provide such a device in which the base has affixed at its upper end a pair of torsion coil springs.

It is a still further object of the present invention to provide such a device in which the springs support a frame that receives arms and a torso of a dummy or pad.

It is a still further object of the present invention to provide such a device in which the arms may be adjusted to adjust the spacing therebetween.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
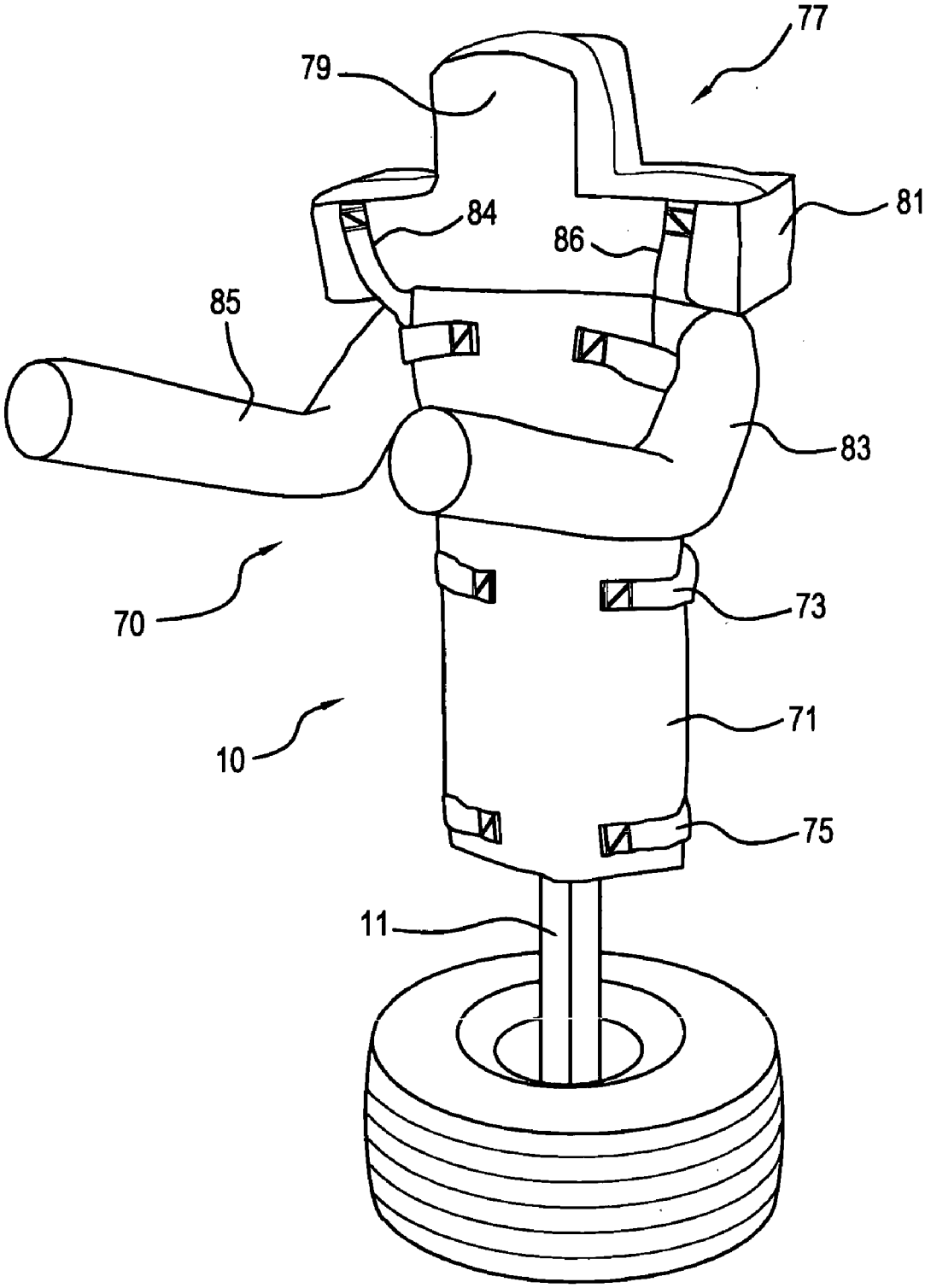
FIG. 1 shows a front left-side perspective view of the present invention.
Figure 2:
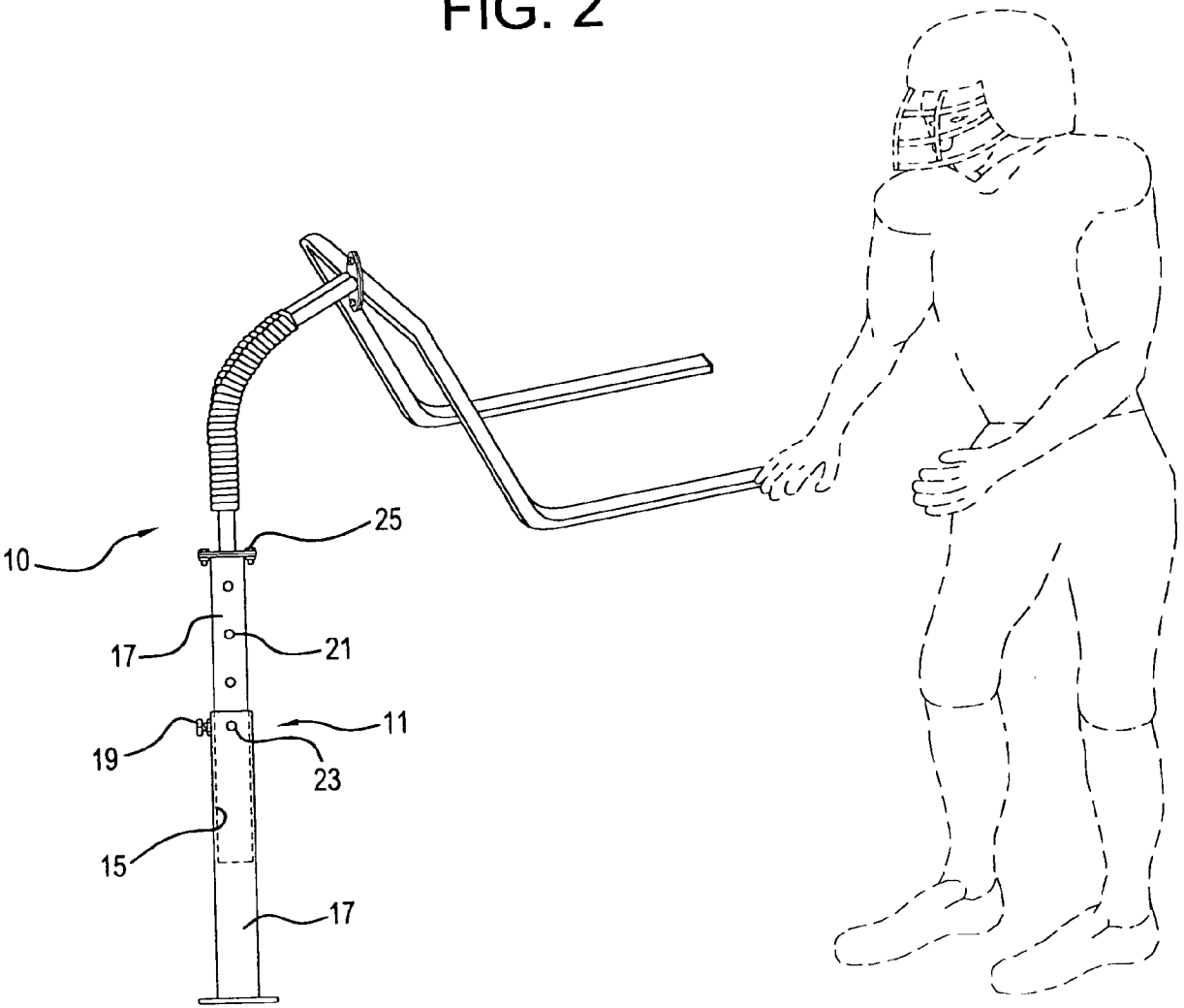
FIG. 2 shows a rear right-side perspective view of the present invention with the pad removed to show detail.

With reference, first, to FIG. 1, the inventive pass rush trainer is generally designated by the reference numeral 10 and includes a base 11, also seen in FIG. 2.

With reference to FIGS. 1 and 2, the base 11 includes a first post 13 having, for example, a square or rectangular cross-section with a hollow square or rectangular passageway therethrough designated by the reference numeral 15. A second post 17 has an outer configuration sized and configured to be slidably received within the passageway in the first post 13. Locking means comprising a locking bolt 19 is provided that may be loosened permitting slidable movement of the post 17 with respect to the post 13, and which may be tightened against the outer wall of the post 17 to frictionally fix the relative position therebetween. If desired, one of the openings 21 of the post 17 may be aligned with the opening 23 in the post 13, whereupon a pin (not shown) can be inserted through both aligned openings to lock the vertical position of the post 17 with respect to the post 13.

Figure 6:
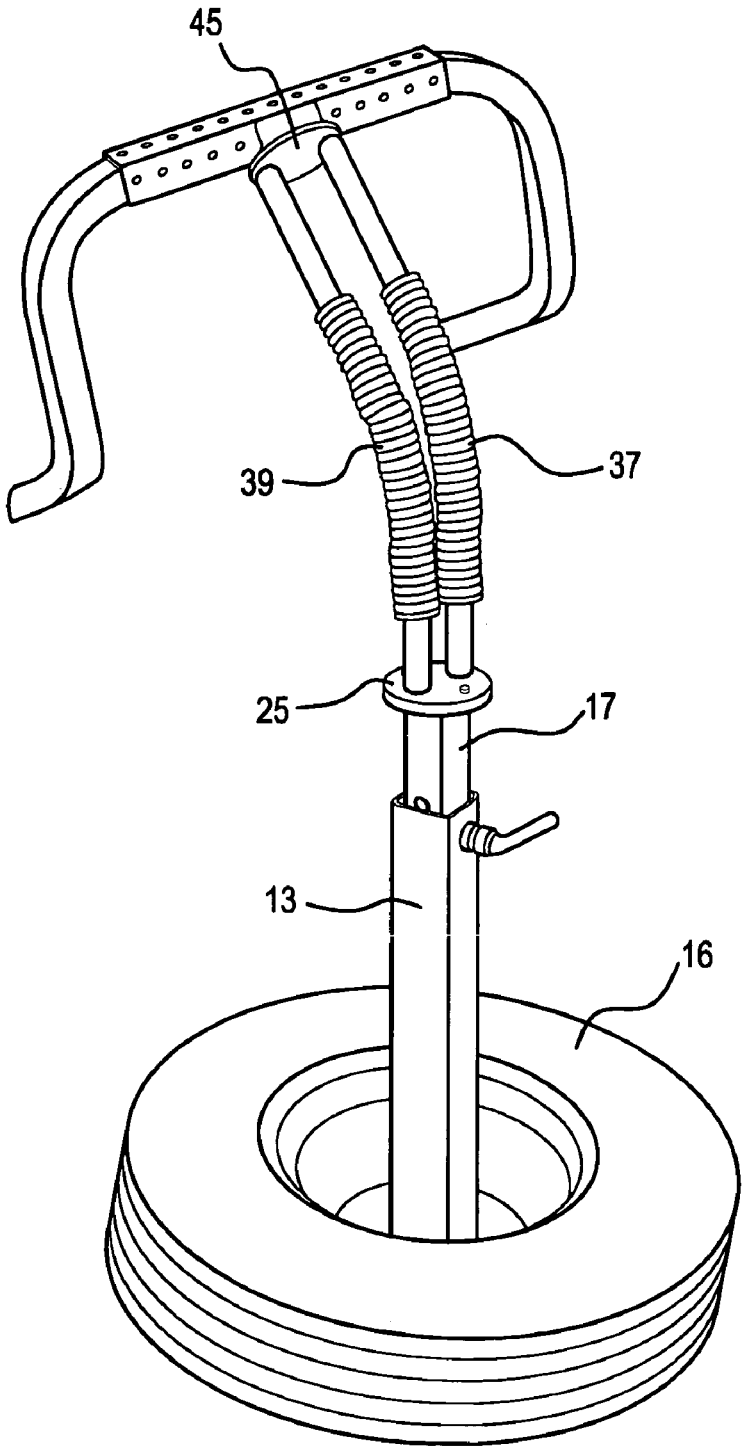
FIG. 6 shows a rear right-side perspective view with the frame twisted to show degree of movement.
Figure 7:
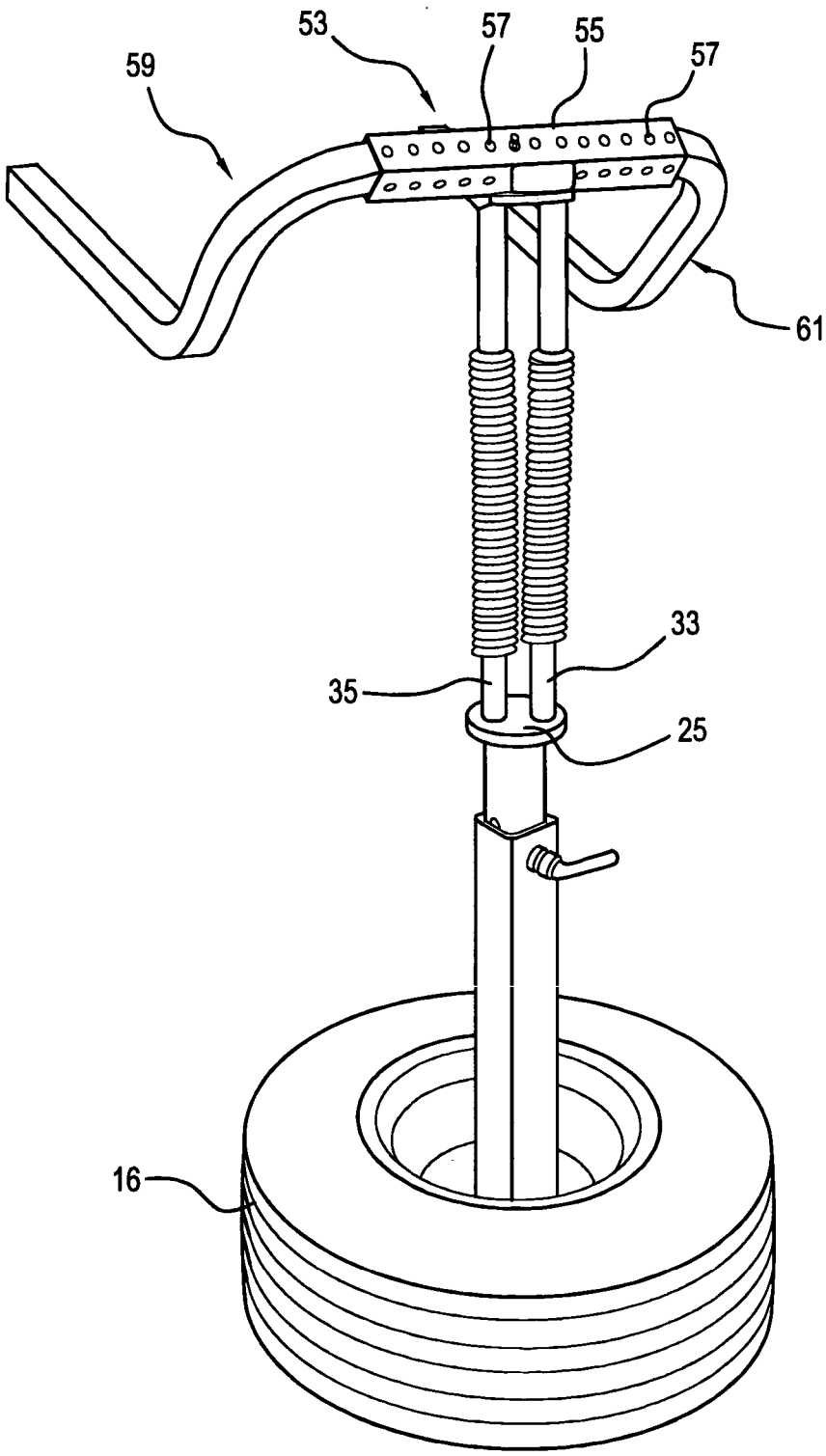
FIG. 7 shows a rear view of the present invention with the lateral adjustability of the frame arms shown.

As best seen in FIGS. 6 and 7, a generally circular plate 25 is mounted on the top of the post 17. In the preferred embodiment, the plate 25 is actually bolted to another plate 27 previously welded to the top of the post 17 by bolts 29 and threaded nuts 31 (FIGS. 3 and 4).

Figure 3:
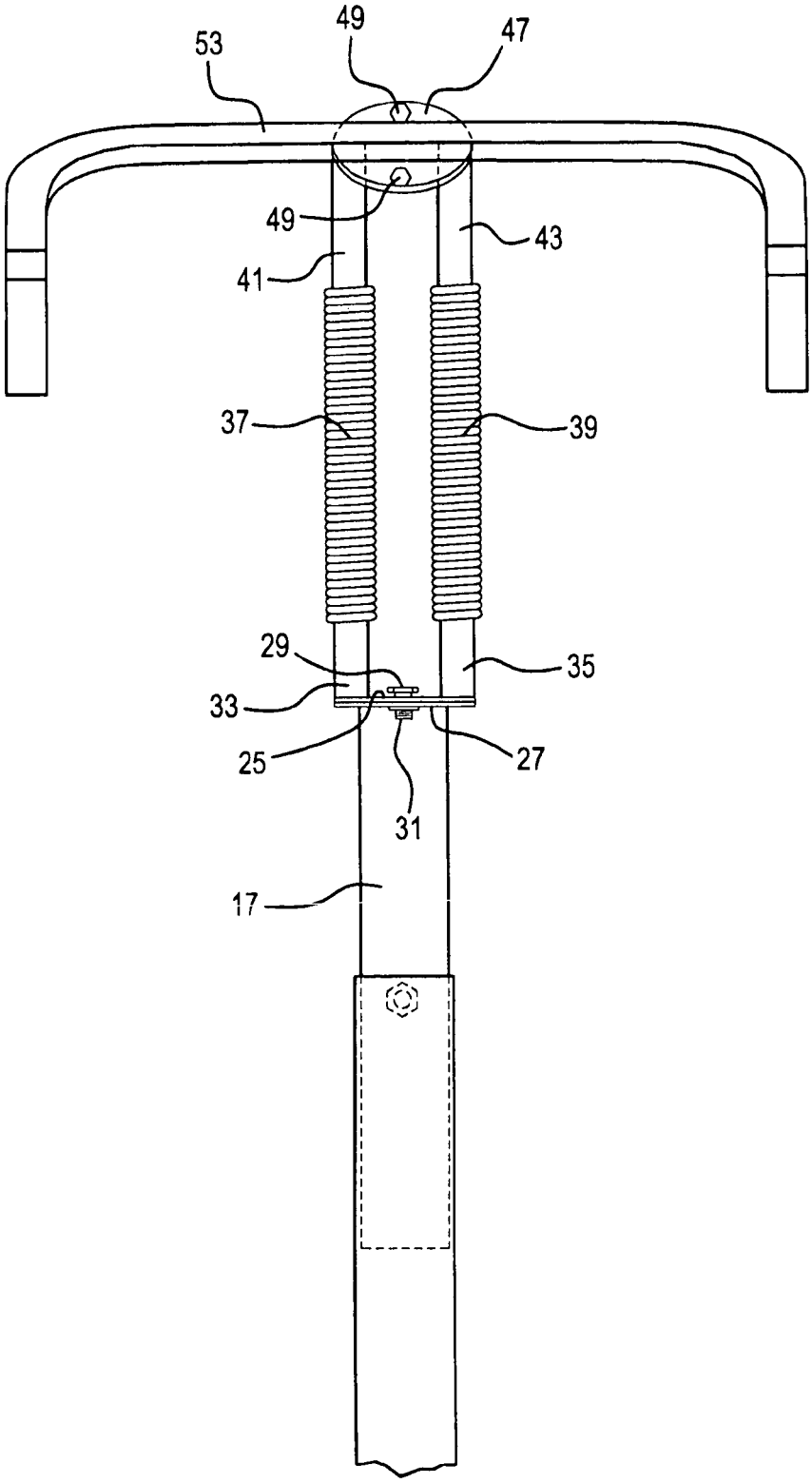
FIG. 3 shows a front view of the present invention with the frame visible through the pad to show detail.
Figure 4:
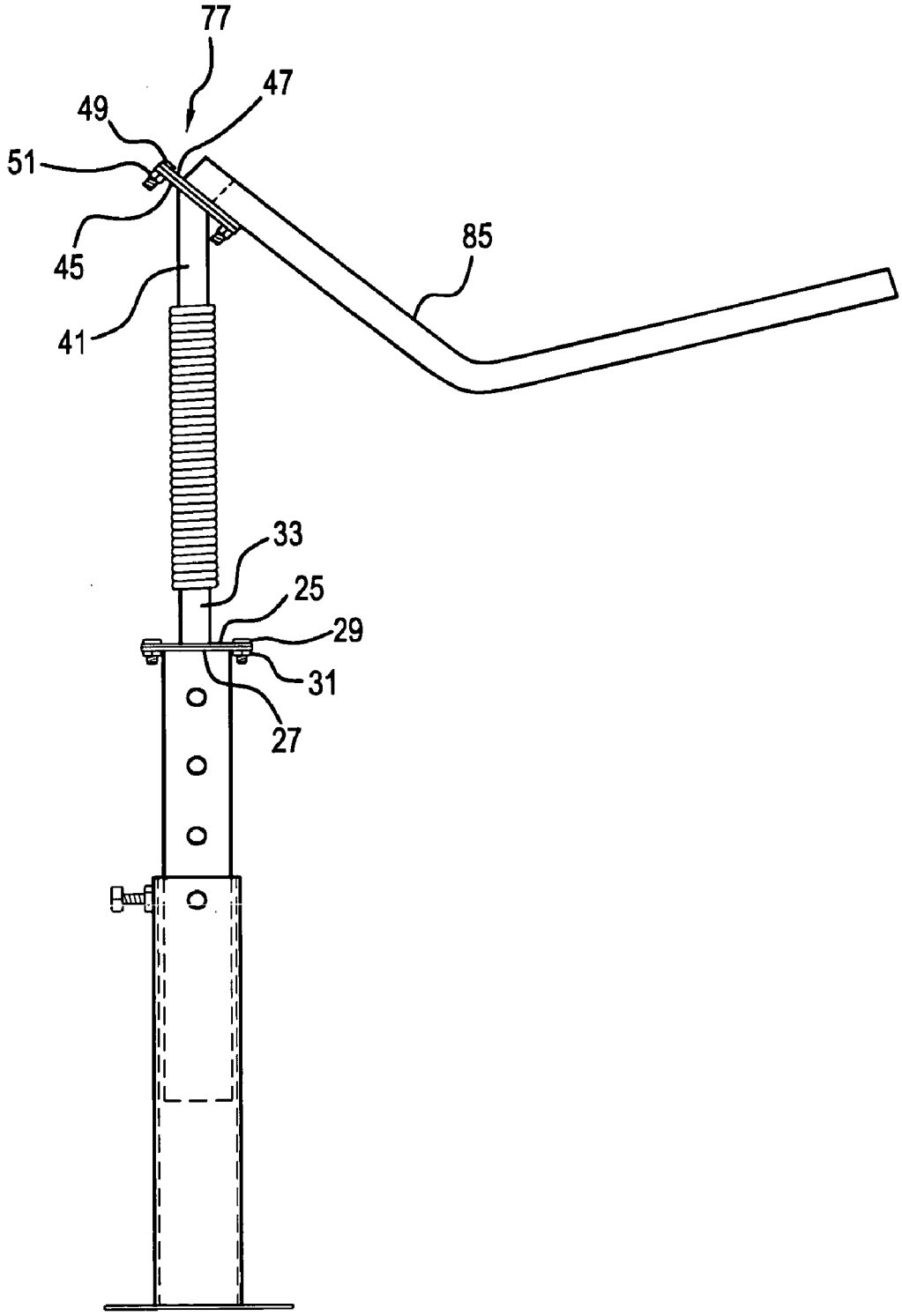
FIG. 4 shows a right side view of the present invention with the frame visible through the pad to show detail.

With reference to FIGS. 3, 4 and 7, the plate 25 has mounted thereon two upstanding posts 33 and 35. The post 33 has mounted thereon an elongated coil torsion spring 37 while the post 35 has mounted thereon an elongated coil torsion spring 39. The springs are preferably parallel. Each of the springs 37 and 39 has an upper end, with the upper end of the spring 39 being fastened to a further post 41, and with the spring 39 having an upper termination attached to a further post 43. These posts 41 and 43, as best seen in FIGS. 3 and 4, are affixed to a further plate 45. The plate 45 is fastened to an additional plate 47 by threaded bolts 49 and threaded nuts 51.

Figure 8:
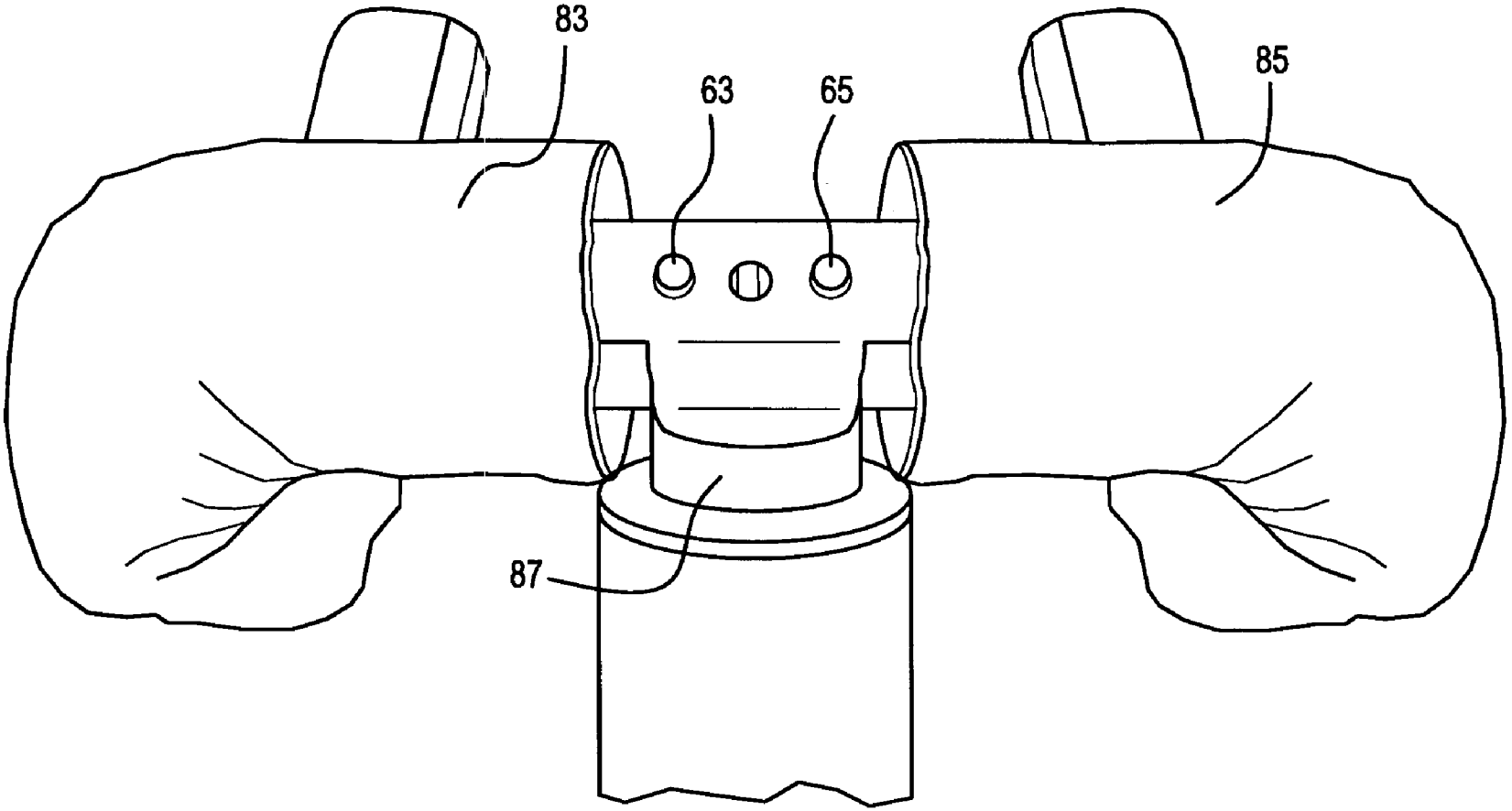
FIG. 8 shows an enlarged rear view of a portion of the present invention showing more detail concerning the lateral adjustability of the arms.

The plate 47 is attached to a horizontal bar 53 (FIG. 3). With reference to FIGS. 7 and 8, it is seen that the horizontal bar may actually be made up of a hollow bar or tube 55 having a plurality of holes 57 therethrough, and arms 59, 61 slidably received within the hollow bar or tube 55. The tube 55, plate 47 and posts 41 and 43 together comprise a bracket. The arm 59 includes a spring biased protrusion 63 while the arm 61 includes a spring biased protrusion 65 (FIG. 8). In order to adjust the lateral position of an arm 59 or 61, the respective protrusion 63 or 65 is depressed until it is freed from insertion through a hole 57, whereupon the arm is laterally adjusted and the protrusion 63 or 65 springs out through one of the openings 57 to lock the lateral position of the arm 59 or 61.

Figure 5:
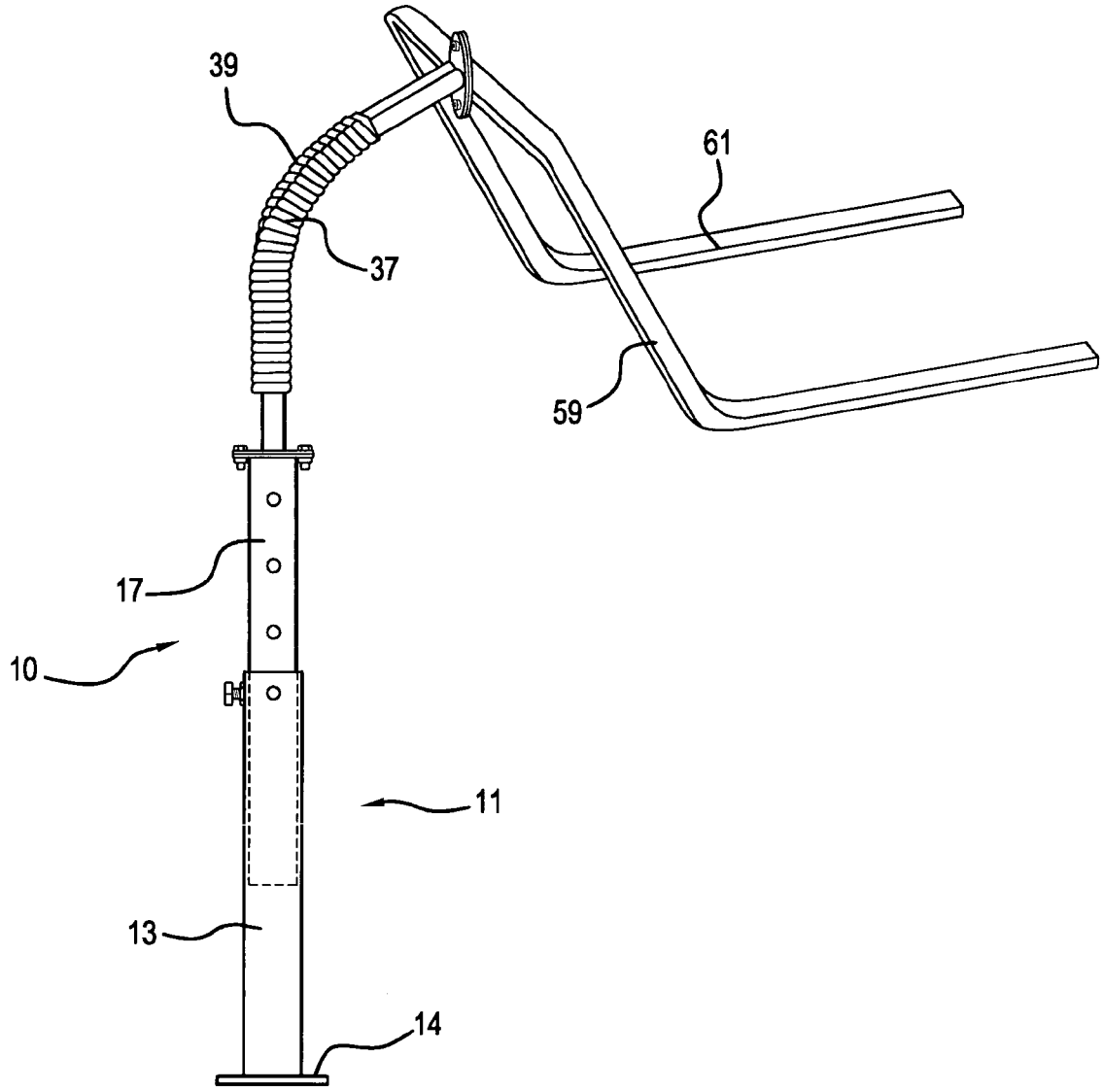
FIG. 5 shows a side view of the present invention with the pad removed to show detail and with the frame slightly flexed to show movement.
Figure 9:
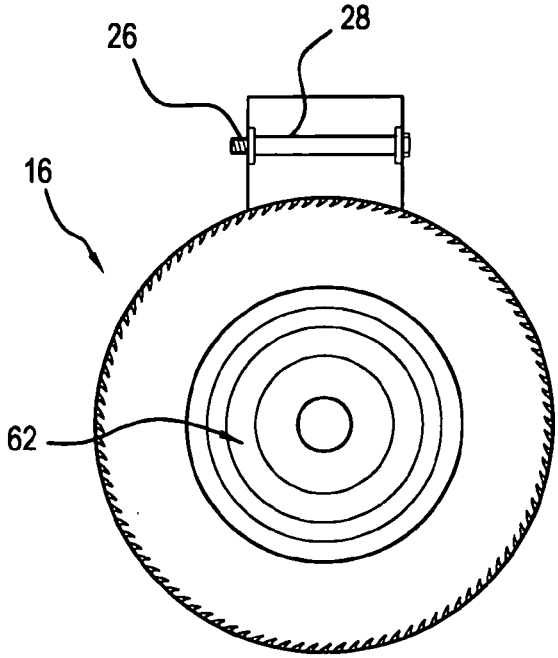
FIG. 9 shows a bottom view of a tire used to support the inventive trainer showing a weight used to increase stability.

With reference to FIG. 5, the first post 13 may have a flange 14 at its lower extremity designed to be used to mount the post 13 to a ground inserted anchor such as, for example, a large piece of formed concrete or other fixed object. Alternatively, with reference to FIGS. 1, 6 and 7, the lower post may be mounted on a tire 16 by any suitable means. If desired, the tire may be filled with water or sand to make it heavier and less susceptible to rocking or other movement. Alternatively or supplementally, as shown in FIG. 9, a weight 62 may be attached under the tire 16 to enhance stability.

With reference back to FIG. 1, it is seen that a pad 70 is mounted over the springs 37, 39, the tube 55, the arms 59, 61, and the post 17. The pad 70 includes a torso portion 71 with straps 73, 75 permitting it to be fixedly mounted about the springs 37, 39 and the post 17. The pad 70 includes a shoulder and head portion 77 including a head portion 79 and a shoulder portion 81. Straps 84 and 86 affix the head and shoulder portion 77 on the torso portion 71. Arm pads 83 and 85 are provided with the arm pad 83 being installed over the arm 61 and with the arm pad 85 being installed over the arm 59. The arm pads 83 and 85 are secured in any suitable manner such as, for example, straps.

As seen in FIG. 8, a strap 87 extends between the arm pads 83 and 85 to hold them together and in assembled relation over the arms 59 and 61. The strap 87 may be extended, if desired, when the arms 59 and 61 are extended in their lateral spacing with respect to one another in the manner explained hereinabove.

As should be understood, the springs 37 and 39 are extremely stiff so that they can easily support the weight of the tube 55, the arms 59, 61, and the pad 70. The concept of using two side-by-side springs 37 and 39 allows the pad 70 to turn, twist and pivot just as does an offensive lineman's body when that player's arm or arms is/are pushed as a defensive pass rusher attempts to defeat the offensive lineman and head toward the backfield.

The elevation of the inventive device 10 may easily be adjusted with the telescoping post 11 and the spacing of the arms 59 and 61 may easily be adjusted through the mechanism shown herein, described above, and designated by the reference numerals 57, 63 and 65.

Figure 10:
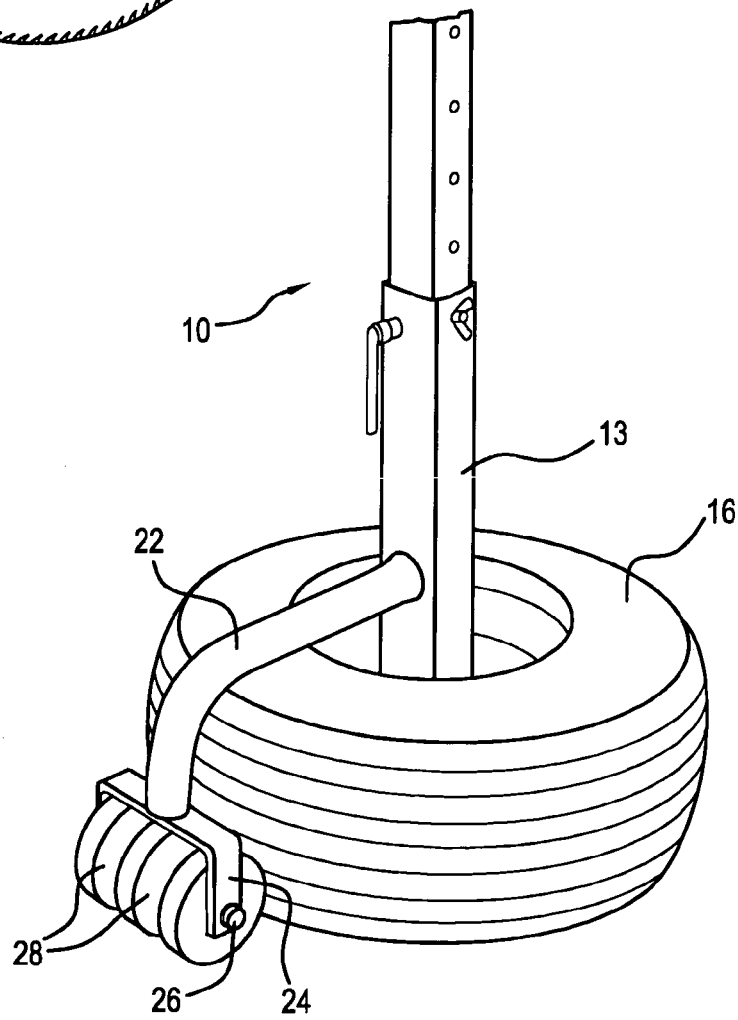
FIG. 10 shows a perspective view of a modification to the tire support shown in FIG. 1.

As seen in FIG. 10, the post 13 may have a curved arm 22 extending therefrom having a C-shaped bracket 24 attached at its end distal from the post 13. An axle 26 fastened to the bracket 24 supports wheels 28. With this structure, the trainer 10 may be tipped off center and the wheels 28 used to easily convey the trainer to a new location.

As such, an invention has been disclosed in terms of a preferred embodiment thereof which fulfills each and every one of the objects of the invention as set forth hereinabove, and provides a new and useful pass rush trainer of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A pass rush trainer, comprising:

a) a vertical base having a first end adapted to be supported on a ground surface and extending to a second end spaced above said ground surface;

b) a plurality of torsion springs extending upwardly from said second end of said base, each spring having (1) a first end attached to a first plate at said second end of said base, and (2) a second end attached to a post, each post having an end remote from the spring to which it is attached, said remote ends of said posts being attached to a common plate forming a part of a bracket;

c) said bracket having two rigid arms extending outwardly therefrom, said springs completely supporting said bracket and arms, said arms being constrained to move together as a unit;

d) whereby said arms may be hit and moved in a plurality of directions against restoring force of said springs; and e) a pad mounted over said springs and bracket.

2. The trainer of claim 1, wherein said first end of said base comprises a first base portion and said second end of said base comprises a second base portion.

3. The trainer of claim 2, wherein said first and second base portions are mounted together in telescoping relation.

4. The trainer of claim 3, wherein said second base portion may be extended with respect to said first base portion, and further including locking means for locking an extended position of said second base portion with respect to said first base portion.

5. The trainer of claim 1, wherein said plurality of springs comprises two springs.

6. The trainer of claim 5, wherein said springs are parallel.

7. The trainer of claim 1, wherein said bracket includes a tube having opposed openings, each of said arms comprising a separate element slidably received in one of said openings of said tube.

8. The trainer of claim 7, wherein each arm may be locked in a desired position of elongation with respect to said tube.

9. The trainer of claim 1, wherein said pad includes portions simulating a human head, shoulders, arms and torso.

10. The trainer of claim 9, wherein said simulations of human arms are mounted over said bracket arms.

11. The trainer of claim 1, wherein said first end of said base is mounted to a tire.

12. The trainer of claim 11, further including a wheel mounted on said base adjacent said tire permitting tipping of said base and transport of said trainer on said wheel.

13. The trainer of claim 1, wherein said first end of said base is mounted on a fixed support embedded below said ground surface.

14. A pass rush trainer, comprising:

a) a vertical base having a first end adapted to be supported on a ground surface and extending to a second end spaced above said ground surface, said first end of said base comprising a first base portion and said second end of said base comprising a second base portion, said first and second base portions being mounted together in telescoping relation;

b) a plurality of parallel torsion springs extending upwardly from said second end of said base, each spring having a first end attached to a first plate at said second end of said base, and a second end attached to a plate forming a part of a bracket;

c) said bracket having two rigid arms extending outwardly therefrom, said springs completely supporting said bracket and arms, said arms being constrained to move together as a unit;

d) whereby said arms may be hit and moved in a plurality of directions against restoring force of said springs;

e) a pad mounted over said springs and bracket, said pad including portions simulating a human head, shoulders, arms and torso, said simulated arms being mounted over said arms of said bracket.

15. The trainer of claim 14, wherein said second base portion may be extended with respect to said first base portion, and further including locking means for locking an extended position of said second base portion with respect to said first base portion.

16. The trainer of claim 14, wherein said bracket comprises a tube having opposed openings, each of said arms comprising a separate element slidably received in one of said openings of said tube, and wherein each arm may be locked in a desired position of elongation with respect to said tube.

17. The trainer of claim 14, wherein said first end of said base is mounted to a tire or on a fixed support embedded below said ground surface.

18. A pass rush trainer, comprising:

a) a vertical base having a first end adapted to be supported on a ground surface and extending to a second end spaced above said ground surface;

b) a plurality of torsion springs extending upwardly from said second end of said base, each spring having a first end attached to a first plate at said second end of said base, and a second end attached to a plate forming a part of a bracket;

c) said bracket having two rigid arms extending outwardly therefrom, said springs completely supporting said bracket and arms, said arms being constrained to move together as a unit, said bracket including a tube having opposed openings, each of said arms comprising a separate element slidably received in one of said openings of said tube;

d) whereby said arms may be hit and moved in a plurality of directions against restoring force of said springs.

19. A pass rush trainer, comprising:

a) a vertical base having a first end adapted to be supported on a ground surface and extending to a second end spaced above said ground surface;

b) a plurality of torsion springs extending upwardly from said second end of said base, each spring having a first end attached to a first plate at said second end of said base, and a second end attached to a plate forming a part of a bracket;

c) said bracket having two rigid arms extending outwardly therefrom, said springs completely supporting said bracket and arms, said arms being constrained to move together as a unit;

d) a pad mounted over said springs and bracket;

e) whereby said arms may be hit and moved in a plurality of directions against restoring force of said springs.

* * * * *